US011728591B2

(12) United States Patent
Suzuki

(10) Patent No.: US 11,728,591 B2
(45) Date of Patent: Aug. 15, 2023

(54) ONE PIECE RUBBER PLUG SEALING A TERMINAL MODULE AND TERMINAL FITTING WITHIN A HOUSING

(71) Applicant: SUMITOMO WIRING SYSTEMS, LTD., Mie (JP)

(72) Inventor: Tomoki Suzuki, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 126 days.

(21) Appl. No.: 17/489,944

(22) Filed: Sep. 30, 2021

(65) Prior Publication Data

US 2022/0109267 A1 Apr. 7, 2022

(30) Foreign Application Priority Data

Oct. 2, 2020 (JP) ..... 2020-167574

(51) Int. Cl.

| | |
|---|---|
| ***H01R 13/52*** | (2006.01) |
| ***H01R 13/502*** | (2006.01) |
| ***H01R 4/18*** | (2006.01) |
| ***H01R 11/11*** | (2006.01) |
| ***H01R 13/639*** | (2006.01) |

(52) U.S. Cl.

CPC ..... *H01R 13/5208* (2013.01); *H01R 4/18* (2013.01); *H01R 11/11* (2013.01); *H01R 13/502* (2013.01); *H01R 13/639* (2013.01)

(58) Field of Classification Search

CPC ..... H01R 4/18; H01R 11/11; H01R 13/502; H01R 13/5208; H01R 13/5205

See application file for complete search history.

(56) References Cited

U.S. PATENT DOCUMENTS

| | | | | |
|---|---|---|---|---|
| 4,944,688 | A * | 7/1990 | Lundergan | H01R 13/5221 439/752 |
| 5,643,018 | A | 7/1997 | Sakai et al. | |
| 6,186,829 | B1 * | 2/2001 | Murakami | H01R 13/5205 439/275 |
| 6,241,554 | B1 * | 6/2001 | Murakami | H01R 13/506 439/587 |
| 6,398,571 | B1 * | 6/2002 | Nishide | H01R 13/5205 439/701 |
| 8,579,519 | B2 * | 11/2013 | Wu | H01R 13/502 385/101 |

(Continued)

FOREIGN PATENT DOCUMENTS

JP 2017-135006 A 8/2017

*Primary Examiner* — Vanessa Girardi
(74) *Attorney, Agent, or Firm* — Venjuris, P.C.

(57) ABSTRACT

A connector includes a housing 11 and terminal fittings 12 and a terminal module 13 to be accommodated into the housing 11. The terminal module 13 includes inner conductor terminals 20 and a dielectric 21 for covering outer peripheries of the inner conductor terminals 20 and has larger external dimensions than the terminal fitting 12. A first wire 81 is connected to a rear part of the terminal fitting 12. A second wire 82 is connected to a rear part of the inner conductor terminal 20 in the terminal module 13. The connector 10 also includes a one-piece rubber plug 63. The one-piece rubber plug 60 is formed with first seal holes 62 through which the first wires 81 are passed in a liquid-tight manner, and a second seal hole 63 through which the second wire 82 is passed in a liquid-tight manner.

6 Claims, 10 Drawing Sheets

(56) References Cited

U.S. PATENT DOCUMENTS

| | | | | |
|---|---|---|---|---|
| 10,033,131 | B2 * | 7/2018 | Uchiyama ..... | H01R 13/5202 |
| 10,297,932 | B2 | 5/2019 | Maesoba et al. | |
| 10,511,116 | B2 | 12/2019 | Maesoba et al. | |
| 10,714,872 | B2 | 7/2020 | Maesoba et al. | |
| 10,763,600 | B2 | 9/2020 | Maesoba et al. | |
| 10,916,876 | B2 | 2/2021 | Maesoba et al. | |
| 10,971,851 | B2 | 4/2021 | Miyamura et al. | |

* cited by examiner

ONE PIECE RUBBER PLUG SEALING A TERMINAL MODULE AND TERMINAL FITTING WITHIN A HOUSING

CROSS-REFERENCE TO RELATED APPLICATIONS

This application is based on and claims priority from Japanese Patent Application No. 2020-167574, filed on Oct. 2, 2020, with the Japan Patent Office, the disclosure of which is incorporated herein in their entireties by reference.

TECHNICAL FIELD

The present disclosure relates to a connector.

BACKGROUND

Japanese Patent Laid-open Publication Nos. H08-007964 and 2017-135006 disclose a connector provided with a one-piece rubber plug. The one-piece rubber plug is formed with a plurality of seal holes. A wire connected to a terminal fitting is passed through each seal hole in a liquid-tight manner.

Japanese Patent Laid-open Publication Nos. 2018-063754, 2018-063795, 2018-063796, 2018-152216 and 2019-149379 disclose a connector provided with a terminal module. The terminal module is configured to cover the outer periphery of an inner conductor terminal connected to a wire by a dielectric. Particularly, Japanese Patent Laid-open Publication No. 2018-152216 discloses a configuration in which a rubber plug is mounted on the outer periphery of the wire connected to the inner conductor terminal.

SUMMARY

In the case of mounting both a terminal fitting and a terminal module into a product in a waterproof manner, a method for respectively mounting the connector disclosed in Japanese Patent Laid-open Publication No. 2017-135006 and the connector disclosed in Japanese Patent Laid-open Publication No. 2018-152216 is considered. However, in this case, there is a problem of increasing the number of components. Accordingly, a method for incorporating a waterproof structure by a one-piece rubber plug disclosed in Japanese Patent Laid-open Publication No. 2017-135006 and a waterproof structure by individual rubber plugs disclosed in Japanese Patent Laid-open Publication No. 2018-063754 into one connector is also considered. However, in this case, there is a problem of complicating the structure of the connector.

Accordingly, the present disclosure aims to simplify a waterproof structure of a connector provided with a terminal fitting and a terminal module.

The present disclosure is directed to a connector with a terminal fitting, a terminal module including an inner conductor terminal and a dielectric for covering an outer periphery of the inner conductor terminal, the terminal module having larger external dimensions than the terminal fitting, a housing for accommodating the terminal fitting and the terminal module, a first wire to be connected to a rear part of the terminal fitting, a second wire to be connected to a rear part of the inner conductor terminal, and a one-piece rubber plug formed with a first seal hole and a second seal hole, the first wire being passed through the first seal hole in a liquid-tight manner, the second wire being passed through the second seal hole in a liquid-tight manner.

According to the present disclosure, it is possible to simplify a waterproof structure of a connector provided with a terminal fitting and a terminal module.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
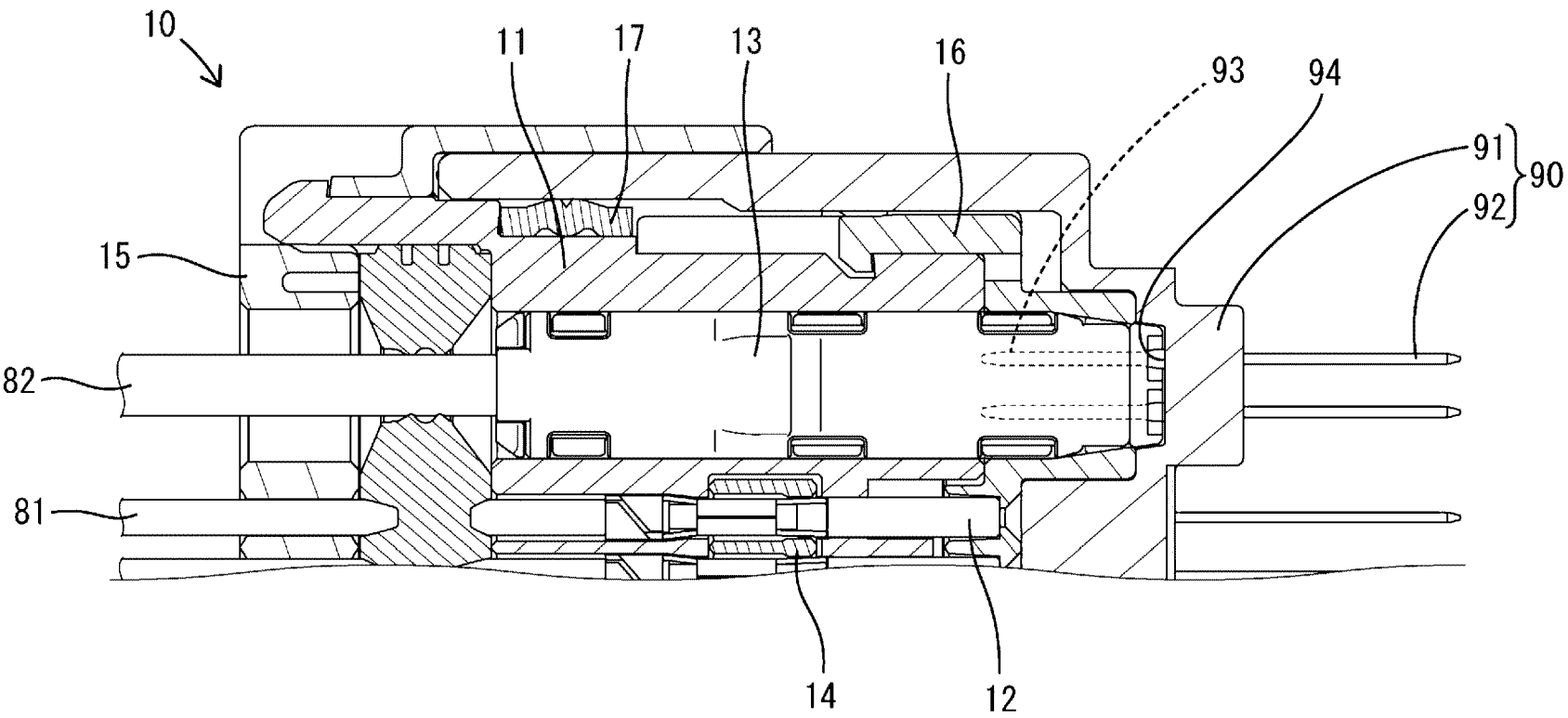
FIG. 1 is a plan view in section showing a state where a connector according to one embodiment is connected to a mating connector.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Description of Embodiments of Present Disclosure

First, embodiments of the present disclosure are listed and described.

(1) The connector of the present disclosure includes a terminal fitting, a terminal module including an inner conductor terminal and a dielectric for covering an outer periphery of the inner conductor terminal, the terminal module having larger external dimensions than the terminal fitting, a housing for accommodating the terminal fitting and the terminal module, a first wire to be connected to a rear part of the terminal fitting, a second wire to be connected to a rear part of the inner conductor terminal, and a one-piece rubber plug formed with a first seal hole and a second seal hole, the first wire being passed through the first seal hole in a liquid-tight manner, the second wire being passed through the second seal hole in a liquid-tight manner.

According to this connector, since the first and second wires can be mounted through one one-piece rubber plug in a liquid-tight manner, both the first and second wires can be collectively waterproofed. Thus, the terminal fitting and the terminal module can be collectively provided in one connector. As a result, a waterproof structure of the connector provided with the terminal fitting and the terminal module can be simplified.

(2) Preferably, the dielectric is formed with a front slope inclined in a direction to reduce the external dimensions toward a front end.

Since the terminal module is configured to cover the outer periphery of the inner conductor terminal by the dielectric, the terminal module is larger than the terminal constituted only by the inner conductor terminal and a difference in radial dimension between the terminal module and the second wire is large. Thus, in inserting the terminal module through the second seal hole, the front end of the terminal module may be caught by the periphery of the second seal hole to cut the one-piece rubber plug. However, according to this configuration, when the terminal module is inserted into the second seal hole from behind, the front slope of the terminal module enters the second seal hole to gradually widen the second seal hole. Thus, the front end of the terminal module is less likely to be caught, with the result that the cutting of the one-piece rubber plug can be suppressed.

(3) Preferably, the dielectric includes a front wall formed with a tab insertion opening, a tab of a mating terminal fitting being inserted through the tab insertion opening, and a guiding surface for guiding the tab into the tab insertion opening, and a projecting piece projecting forward from the front wall, and the front slope is provided on the projecting piece.

According to this configuration, the front slope can be arranged forward of the front wall. Thus, the external dimensions of the front end of the terminal module can be further reduced. As a result, the front end of the terminal module is even less likely to be caught by the one-piece rubber plug.

(4) Preferably, the dielectric is formed with a rear slope inclined in a direction to reduce the external dimensions toward a rear end.

Since the terminal module is configured to cover the outer periphery of the inner conductor terminal by the dielectric, the terminal module is larger than the terminal constituted only by the inner conductor terminal and a difference in radial dimension between the terminal module and the second wire is large. Thus, in pulling out the terminal module from a state where the second wire is passed through the second seal hole, the rear end of the terminal module may be caught by the periphery of the second seal hole to cut the one-piece rubber plug. However, according to this configuration, the rear slope of the terminal module can enter the second seal hole to gradually widen the second seal hole in pulling out the terminal module. Thus, the rear end of the terminal module is less likely to be caught, with the result that the cutting of the one-piece rubber plug can be suppressed.

(5) Preferably, the housing includes a locking lance, and a recess is formed in an outer peripheral surface of the terminal module, the locking lance being locked to the recess.

In this terminal module, not a projection, but the recess is formed as a part to be locked to the locking lance of the housing. Thus, when the terminal module is inserted into the second seal hole, the terminal module does not largely push and widen the second seal hole and is less likely to be caught by the one-piece rubber plug. As a result, the cutting of the one-piece rubber plug can be suppressed.

(6) Preferably, the one-piece rubber plug includes four corner parts, and the second seal hole is arranged on the side of any one of the four corner parts.

Since the terminal module is configured to cover the outer periphery of the inner conductor terminal by the dielectric, the terminal module is larger than the terminal constituted only by the inner conductor terminal and a difference in radial dimension between the terminal module and the second wire is large. Thus, in inserting the terminal module into the second seal hole, the front end of the terminal module may be caught by the periphery of the second seal hole to cut the one-piece rubber plug. In contrast, in this configuration, the second seal hole is arranged on the side of any one of the four corner parts in the one-piece rubber plug in a front view. Thus, a part of the one-piece rubber plug on the side of the corner part is thinned by the second seal hole and is easily deflected. Thus, the front end of the terminal module is less likely to be caught, with the result that the cutting of the one-piece rubber plug can be suppressed. Moreover, since the second wire can be arranged away from the first wire, the second wire is less likely to be affected by noise from the first wire.

Details of Embodiments of Present Disclosure

A specific example of the present disclosure is described below with reference to the drawings. Note that the present invention is not limited to these illustrations and is intended to be represented by claims and include all changes in the scope of claims and in the meaning and scope of equivalents.

Embodiment

A connector 10 as a waterproof connector is illustrated in one embodiment. The connector 10 is connected to a mating connector 90 as shown in FIG. 1.

Note that, in the following description, a side of the mating connector 90 with respect to the connector 10 at the time of connecting the connector 10 and the mating connector 90 is referred to as a front side and an opposite side thereof is referred to as a rear side. Further, a vertical direction shown in FIGS. 3 and 6 to 10 is directly defined as a vertical direction. A lateral direction when the connector 10 is viewed from front is defined as a lateral direction.

The connector 10 includes a housing 11, a plurality of terminal fittings 12, a terminal module 13, a retainer 14, a rear member 15, a front member 16, a seal ring 17, first wires 81 and a second wire 82.

The terminal fitting 12 is a female terminal fitting and formed, such as by bending a metal plate. The first wire 81 is connected to a rear part of the terminal fitting 12 by crimping. The first wire 81 is configured to surround an elongated conductor with a coating, and is not a shielded wire.

Figure 2:
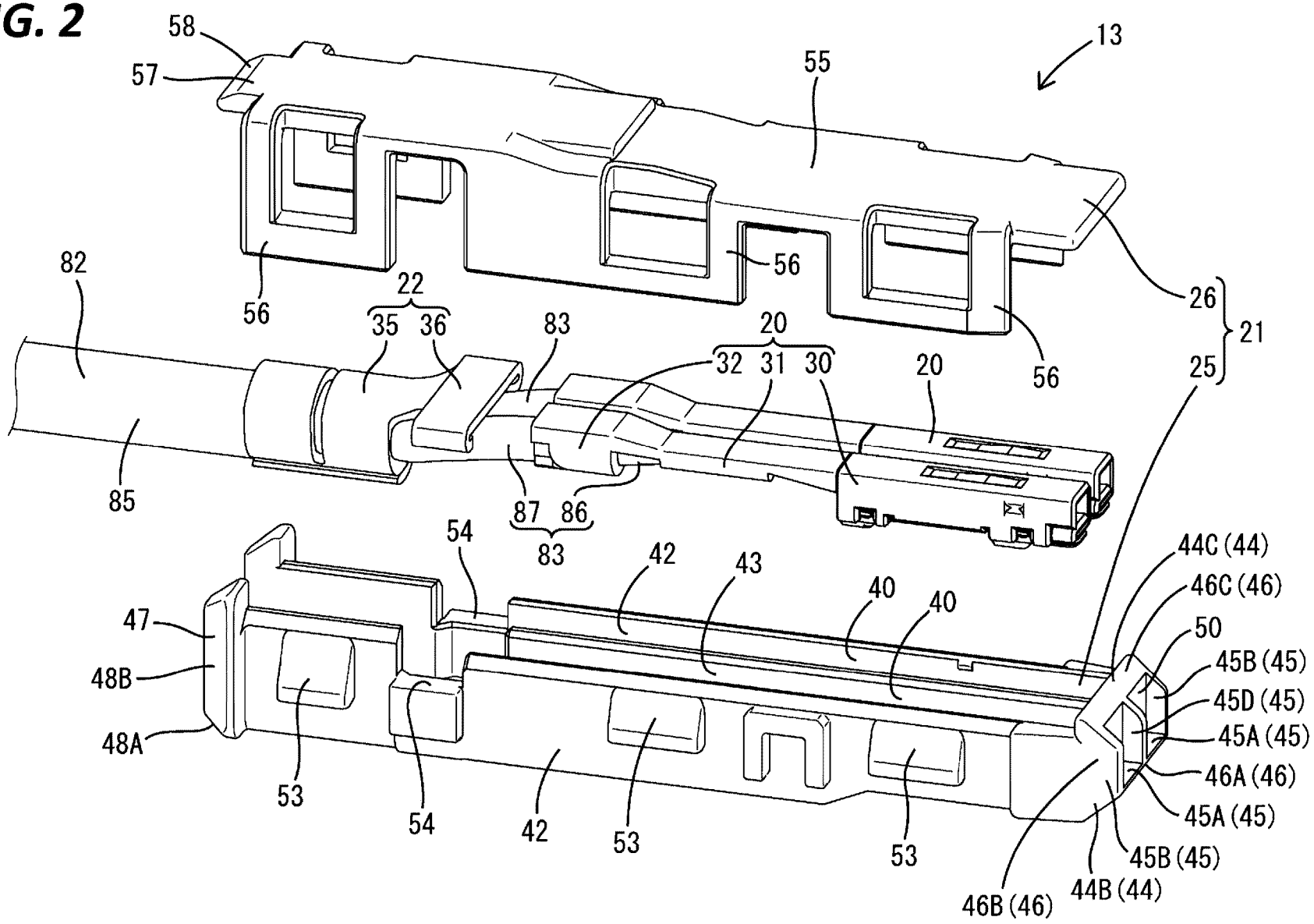
FIG. 2 is an exploded perspective view of a terminal module connected to a second wire.
Figure 3:
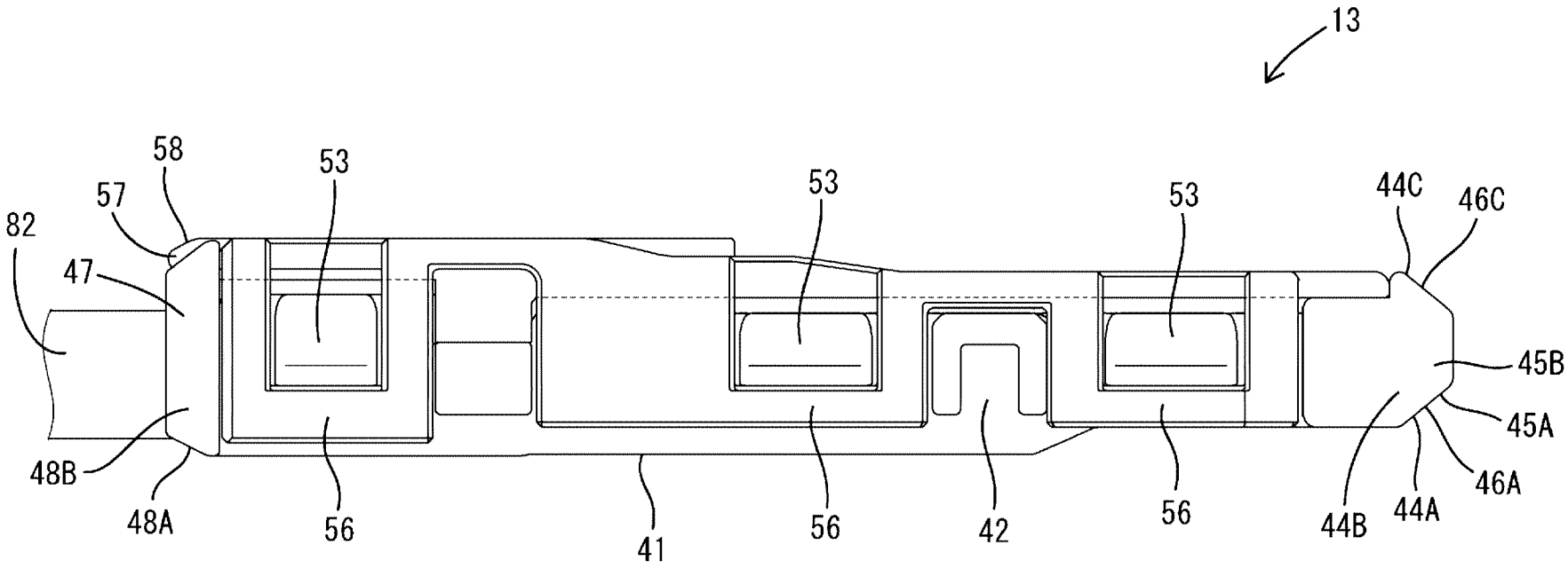
FIG. 3 is a side view of the terminal module connected to the second wire.
Figure 4:
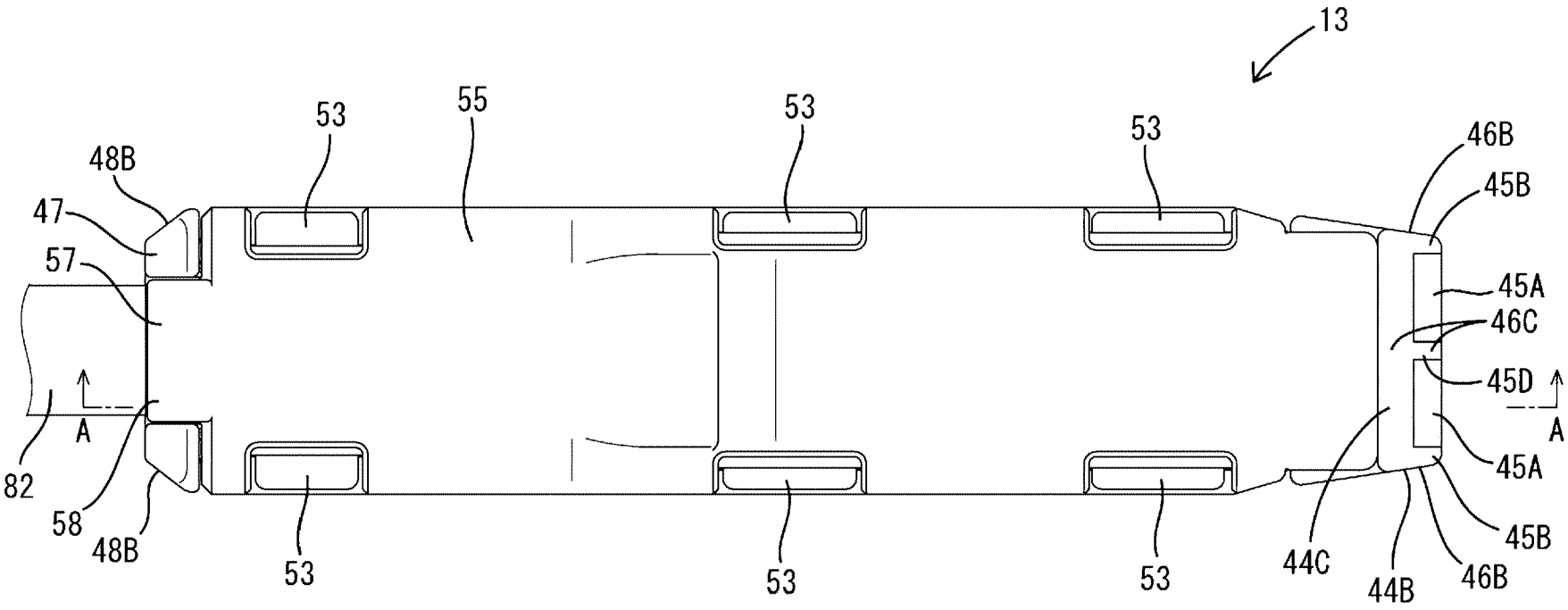
FIG. 4 is a plan view of the terminal module connected to the second wire.
Figure 5:
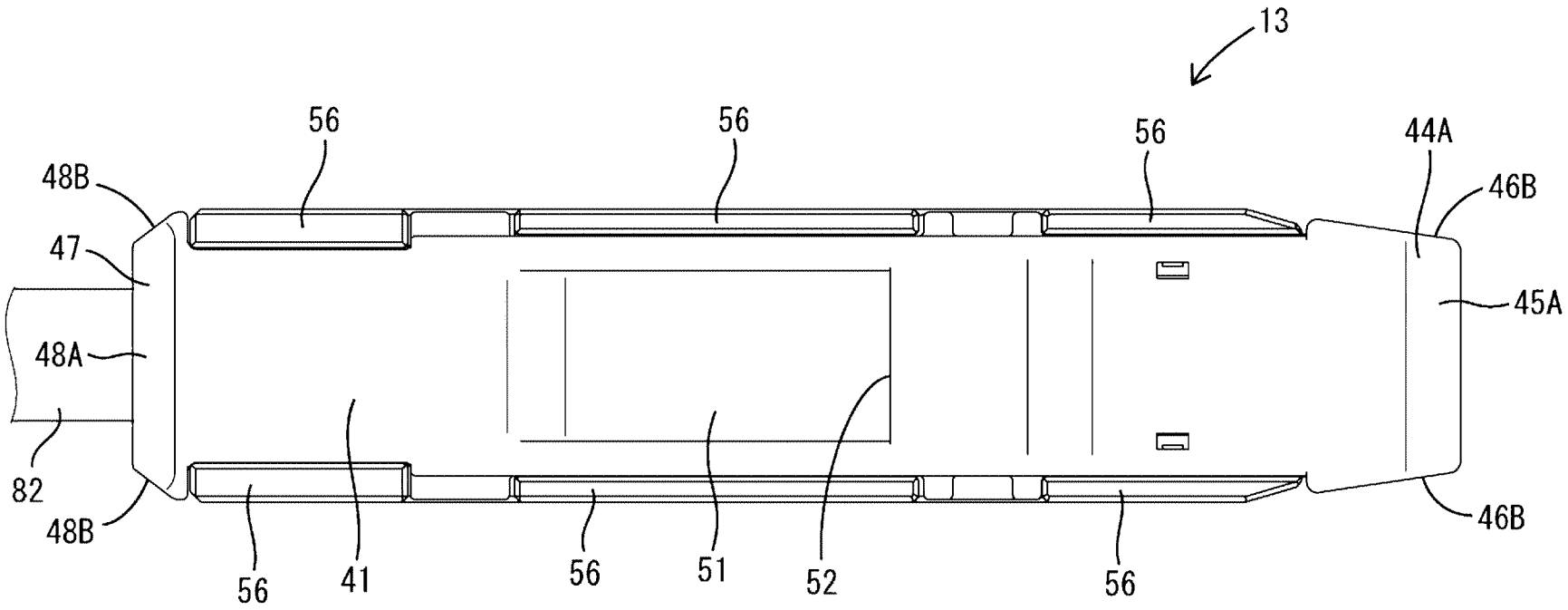
FIG. 5 is a bottom view of the terminal module connected to the second wire.

As shown in FIG. 2, the terminal module 13 includes a pair of inner conductor terminals 20, a dielectric 21 and a crimp ring 22. The inner conductor terminal 20 is a female terminal fitting and formed, such as by bending a metal plate. The inner conductor terminal 20 includes a body portion 30, a wire barrel 31 and an insulation barrel 32. The body portion 30 is in the form of a rectangular tube and connected to a mating terminal 92 of the mating connector 90. The mating terminal 92 is configured as a male terminal fitting.

The wire barrel 31 and the insulation barrel 32 are disposed behind the body portion 30 and crimped to the second wire 82. The second wire 82 is configured as a UTP (Unshielded Twisted Pair) cable and includes a pair of twisted wires 83 and an insulation outer sheath 85 collectively surrounding the pair of wires 83. Each of the pair of wires 83 includes a core 86 and an insulation inner sheath 87 surrounding the corer 86. In a tip part of the second wire 82, the insulation outer sheath 85 is removed to expose the pair of wires 83. Further, the insulation inner sheath 87 is removed to expose the core 86 in a tip part of each wire 83. The wire barrel 31 is crimped to the exposed core 86. The insulation barrel 32 is crimped to the insulation inner sheath 87 of the wire 83. In this way, the second wire 82 is connected to a rear part of each inner conductor terminal 20.

The crimp ring 22 is formed, such as by bending a metal plate. The crimp ring 22 includes a crimping portion 35 to be crimped to the second wire 82 and a positioning portion 36 extending in a lateral direction.

The dielectric 21 shown in FIGS. 2 to 8 is made of synthetic resin and has a shape elongated in a front-rear direction as a whole. The dielectric 21 includes a first cover member 25 and a second cover member 26, and the first and second cover members 25, 26 are vertically united with each other. Note that a state where the first and second cover members 25, 26 are united is called a united state below.

The first cover member 25 is formed with a pair of accommodation grooves 40 open upward and rearward. The first cover member 25 includes a bottom wall 41, a pair of left and right side walls 42 and a separation wall 43. The bottom wall 41 constitutes the bottom surfaces of the accommodation grooves 40. The side walls 42 are connected to both left and right ends of the bottom wall 41 and arranged on both left and right sides of the pair of accommodation grooves 40. The separation wall 43 is arranged between the pair of accommodation grooves 40 to partition between the pair of accommodation grooves 40. The inner conductor terminal 20 is arranged in each accommodation groove 40.

Figure 6:
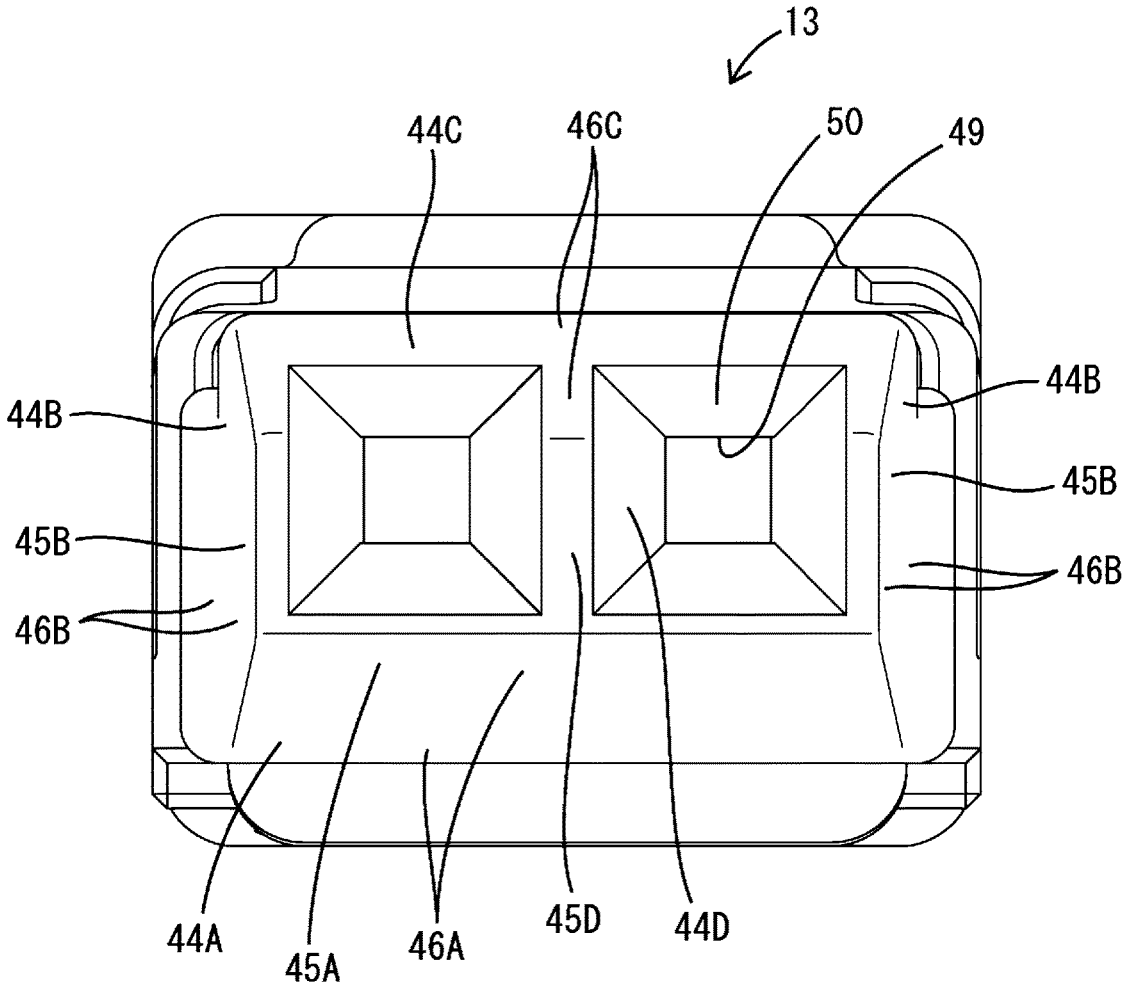
FIG. 6 is a front view of the terminal module except inner conductor terminals and a crimp ring.
Figure 7:
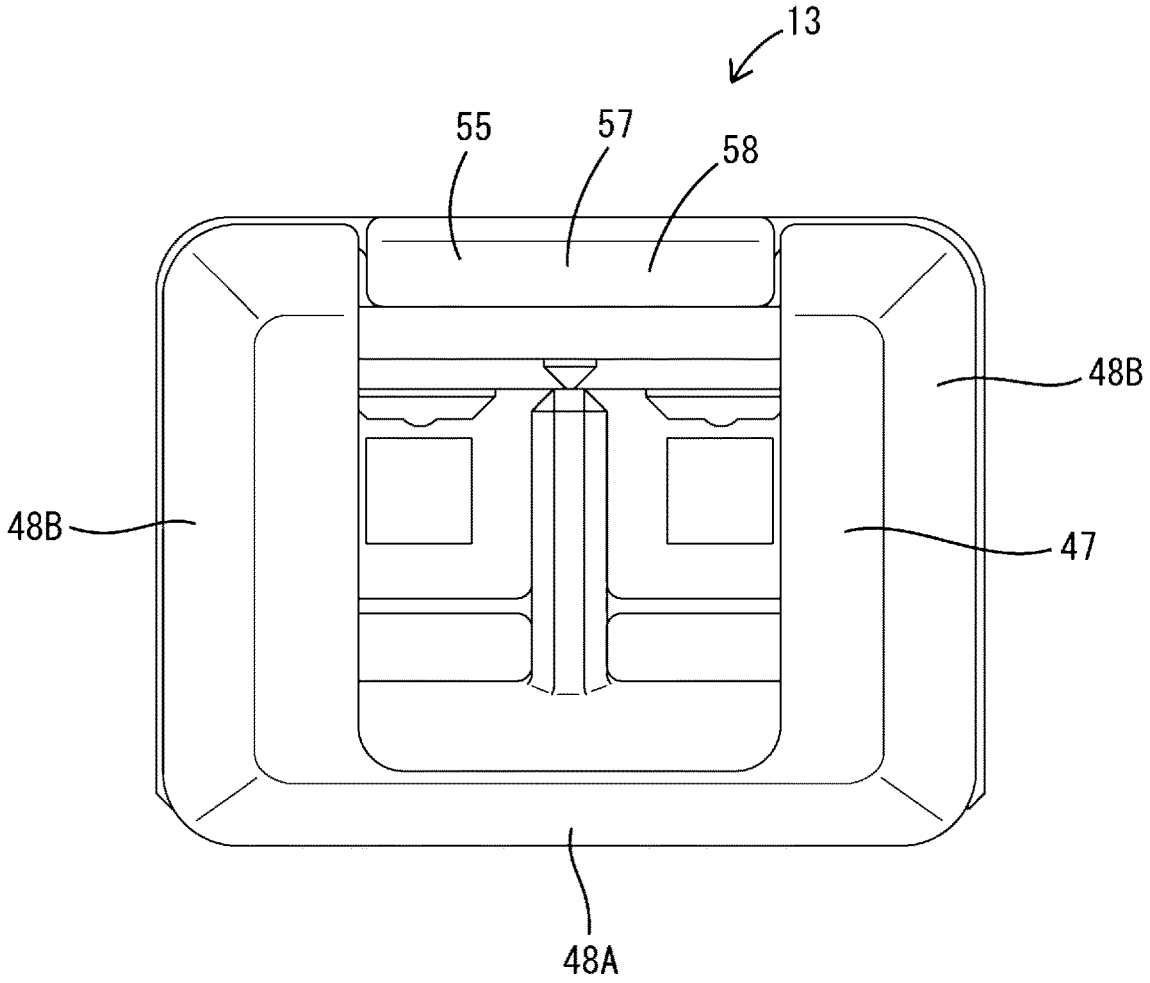
FIG. 7 is a back view of the terminal module except the inner conductor terminals and the crimp ring.

The first cover member 25 includes a front wall 44 arranged in front of the pair of accommodation grooves 40. The front wall 44 restricts forward displacements of the inner conductor terminals 20 arranged in the accommodation grooves 40. The front wall 44 is connected to the front ends of the bottom wall 41 and the pair of side walls 42. As shown in FIG. 6, the front wall 44 includes a pair of left and right tab insertion openings 49 penetrating in the front-rear direction and a pair of left and right guiding surfaces 50 widened forward to guide tabs 93 of the mating terminals 92 into the tab insertion openings 49. The front wall 44 includes a first front wall portion 44A arranged on a lower side, second front wall portions 44B arranged on both left and right sides and a third front wall portion 44*c* arranged on an upper side with respect to the pair of guiding surfaces 50. A vertical dimension of the first front wall portion 44A is larger than that of the third front wall portion 44C. Further, the front wall 44 includes a fourth front wall portion 44D arranged between the pair of guiding surfaces 50.

The first cover member 25 includes projecting pieces 45 projecting forward from the front wall 44. The projecting pieces 45 project further forward than the guiding surfaces 50. The projecting pieces 45 include a first projecting piece 45A projecting forward from the first front wall portion 44A, second projecting pieces 45B projecting forward from the second front wall portions 44B on both left and right sides and a fourth projecting piece 45D projecting forward from the fourth front wall portion 44D. Note that no projecting piece 45 is provided on a front side of the third front wall portion 44C (see FIG. 2).

The first cover member 25 has front slopes 46 on a front part. The front slopes 46 are continuously formed from four surfaces on the outer periphery of the front wall 44 to four surfaces on the outer peripheries of all the projecting pieces 45. The front slopes 46 are inclined to reduce external dimensions of the front wall 44 and all the projecting pieces 45 toward a front side. Specifically, a first front slope 46A inclined upward toward the front side is formed on the lower surfaces of the first front wall portion 44A and the first projecting piece 45A. A second front slope 46B inclined rightward toward the front side is formed on the left surfaces of the second front wall portion 44B and the second projecting piece 45B on the left side. A second front slope 46B inclined leftward toward the front side is formed on the right surfaces of the second front wall portion 44B and the second projecting piece 45B on the right side. A third front slope 46C inclined downward toward the front side is formed on the upper surfaces of the third front wall portion 44C, the second projecting pieces 45B and the fourth projecting piece 45D. Further, the upper surface of the first projecting piece 45A is arranged along the front-rear direction and connected to the front ends of the guiding surfaces 50.

The first cover member 25 includes a rear wall 47 constituting a rear end part of the first cover member 25. The rear wall 47 is connected to the rear ends of the bottom wall 41 and the side walls 42 on both left and right sides and projects rearward. The rear wall 47 is shaped to be open in the front-rear direction and upward. The second wire 82 connected to the inner conductor terminals 20 is passed between both left and right side parts of the rear wall 47. Both left and right ends of the rear wall 47 project further laterally outward than the side walls 42 on both left and right sides.

The first cover member 25 includes a first rear slope 48A and second rear slopes 48B. The first and second rear slopes 48A, 48B are inclined to reduce external dimensions of the terminal module 13 toward a rear side. Specifically, the first rear slope 48A is formed on the lower surface of the rear wall 47 and inclined upward toward the rear side. The second rear slopes 48B are formed on both left and right end surfaces of the rear wall 47 and inclined laterally inwardly toward the front side.

Figure 8:
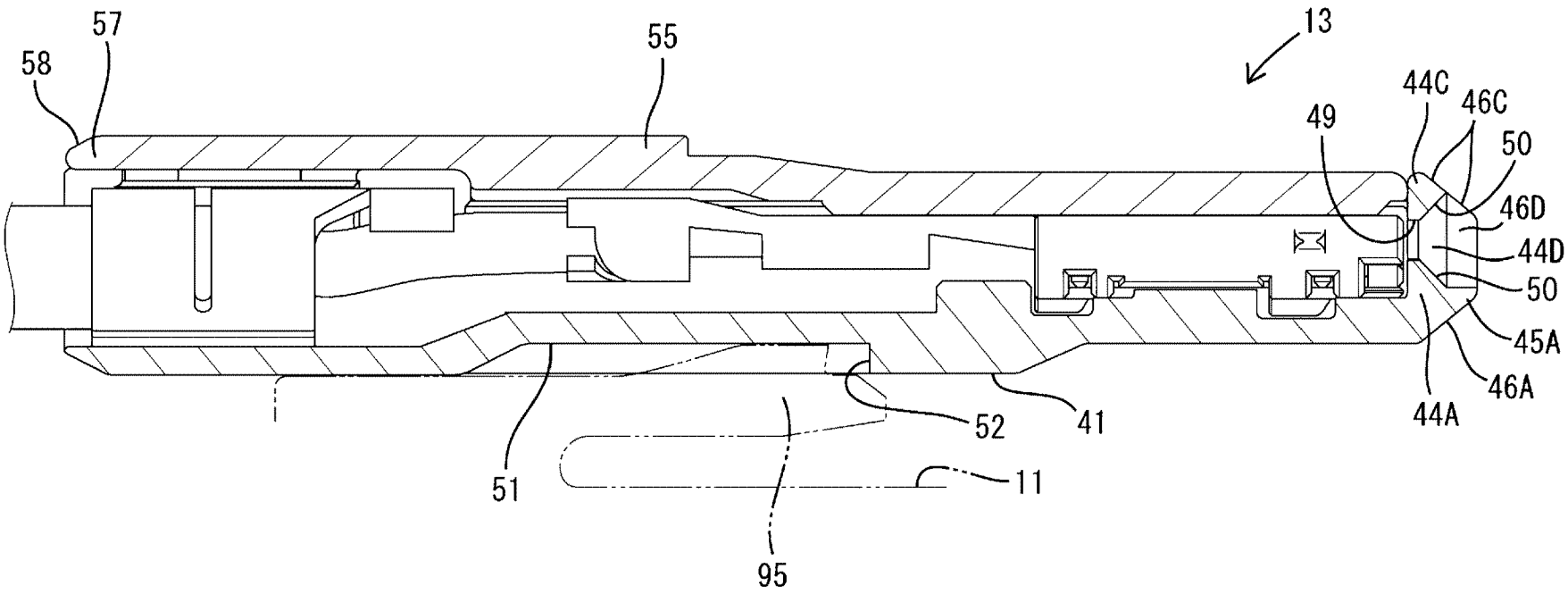
FIG. 8 is a section along A-A of FIG. 4.

As shown in FIG. 8, a recess 52 to be locked to a locking lance 95 of the housing 11 is formed in the lower surface of the aforementioned bottom wall 41. The recess 51 is formed by recessing the lower surface of the bottom wall 41 upward. A lock receiving surface 52 to be locked to the locking lance 95 is formed on the front surface of the recess 51.

As shown in FIG. 2, the first cover member 25 includes a plurality of lock receiving portions 53. Pairs of the lock receiving portions 53 are provided on outer left and right side surfaces of the side walls 42 on both left and right sides. The lock receiving portions 53 are provided at three positions spaced apart in the front-rear direction.

Positioning grooves 54 into which the positioning portion 36 of the crimp ring 22 is fit are formed in the side walls 42 on both left and right sides. The positioning grooves 54 are open in the lateral direction and upward. The inner conductor terminals 20 connected to the second wire 82 are positioned in the front-rear direction by fitting the positioning portion 36 of the crimp ring 22 into the positioning grooves 54.

The second cover member 26 includes an upper wall portion 55 long in the front-rear direction and a plurality of lock portions 56 extending downward from both left and right sides of the upper wall portion 55. The upper wall portion 55 is arranged above the pair of accommodation grooves 40 of the first cover member 25 in the united state. The upper wall portion 55 is arranged behind the front wall 44 of the first cover member 25 in the united state. The upper wall portion 55 includes a rear end part 57 arranged between the both left and right side parts of the rear wall 47 in the first cover member 25 in the united state. The upper surface of the rear end part 57 of the upper wall portion 55 is arranged higher than the upper surface of the rear wall 47. A third rear slope 58 inclined downward toward the rear side is formed on the upper surface of the rear end part 57.

The lock portions 56 are provided at positions corresponding to the lock receiving portions 53 of the first cover member 25. When the first and second cover members 25, 26 are brought closer to each other in the vertical direction, the lower ends of the lock portions 56 are pressed laterally outward by the lock receiving portions 53 to be resiliently deformed. When the lock portions 56 ride over the lock receiving portions 53, the lock portions 56 resiliently return and are locked to the lock receiving portions 53. In this way, the first and second cover members 25, 26 are held in the united state.

Figure 9:
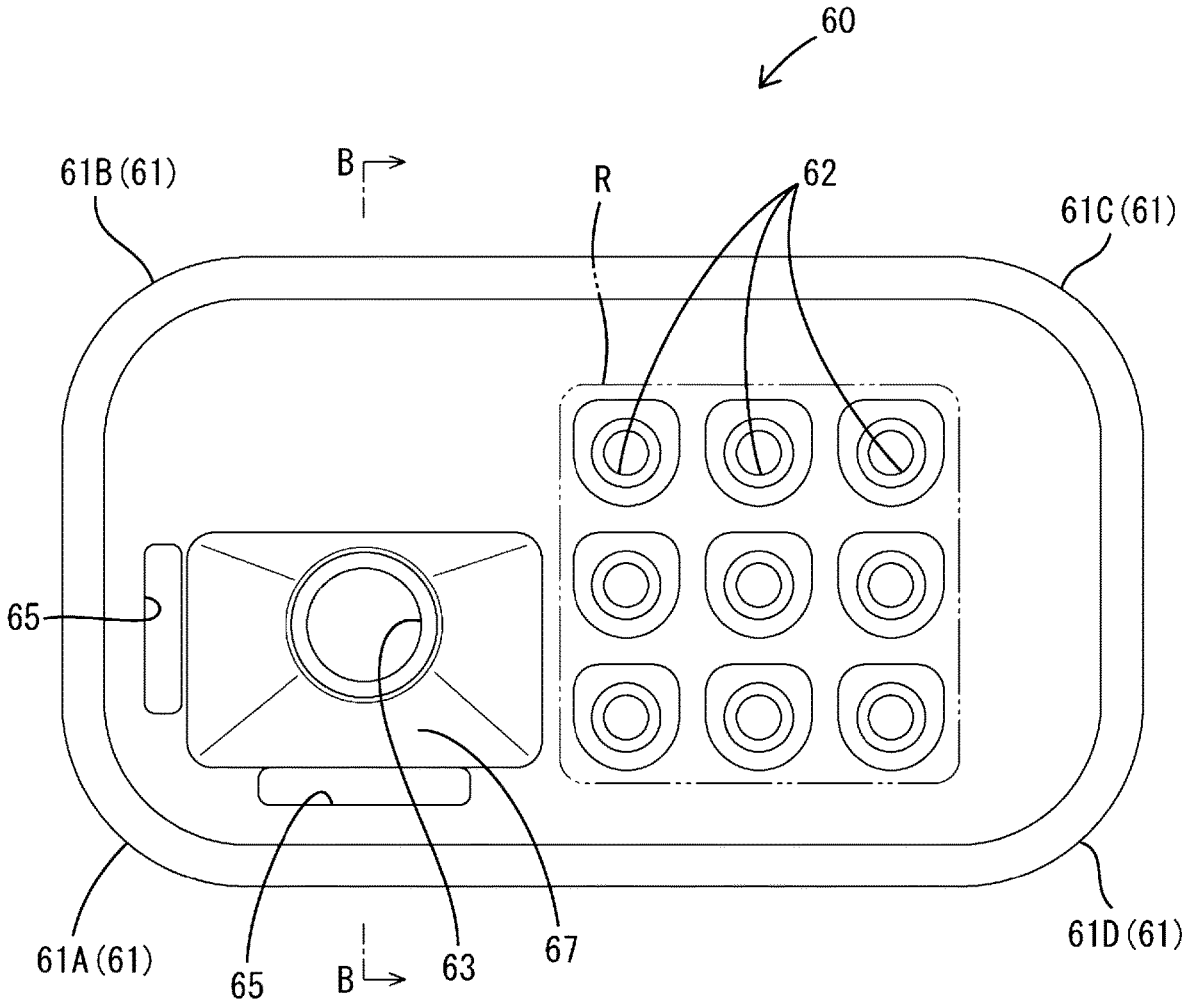
FIG. 9 is a back view of a one-piece rubber plug.
Figure 10:
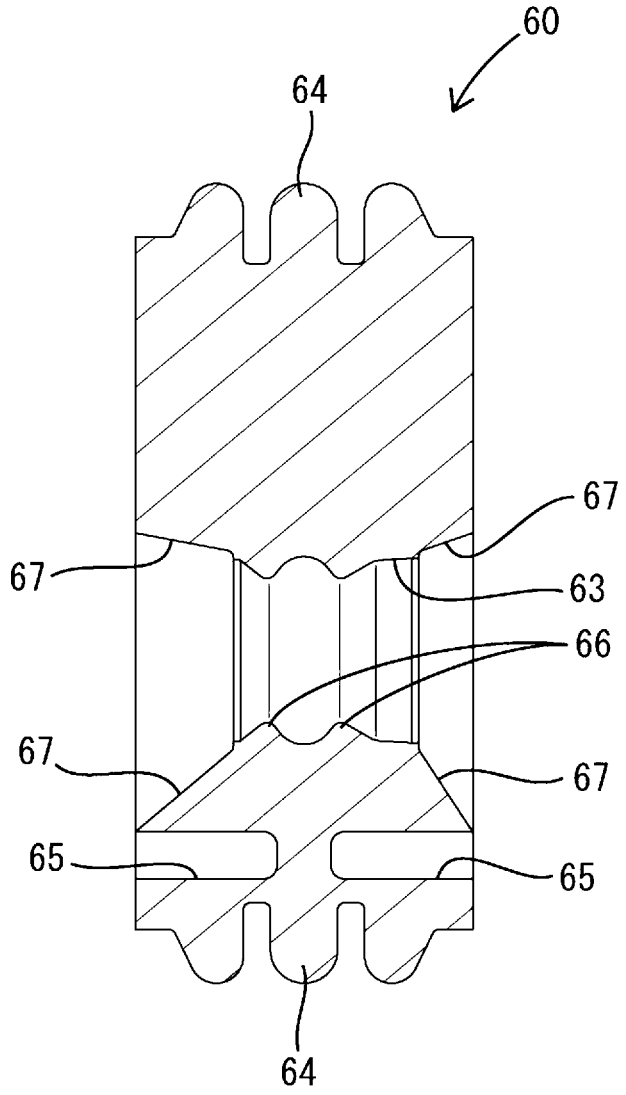
FIG. 10 is a section along B-B of FIG. 9.

The connector 10 includes a one-piece rubber plug 60. As shown in FIGS. 9 and 10, the one-piece rubber plug 60 has a thickness in the front-rear direction and has a rectangular shape long in the lateral direction in a front view. As shown in FIG. 9, the outer periphery of the one-piece rubber plug 60 has four corner parts 61 and outer peripheral lips 64 extending over the entire periphery. The four corner parts 61 include a left-lower corner part 61A, a left-upper corner part 61B, a right-upper corner part 61C and a right-lower corner part 61D. The four corner parts 61 of this embodiment are rounded, but may be right-angled. The one-piece rubber plug 60 is formed with a plurality of first seal holes 62 and one second seal hole 63 penetrating in the front-rear direction.

The first wires 81 connected to the terminal fittings 12 are passed through the first seal holes 62 in a liquid-tight manner. The first seal holes 62 are regularly arranged in the lateral and vertical directions from a laterally central part to a right part of the one-piece rubber plug 60 in a back view.

The second wire 82 connected to the terminal module 13 is passed through the second seal hole 63 in a liquid-tight manner. The second seal hole 63 is arranged on the side of the left-lower corner part 61A in the back view. The second seal hole 63 is arranged away from a region of a group of seal holes constituted by the plurality of first seal holes 62 (region R enclosed by a two-dot chain line in FIG. 9). The second seal hole 63 is arranged at a position not to be sandwiched by the plurality of first seal holes 62. Grooves 65 are formed in both front and rear surfaces between the second seal hole 63 and an outer peripheral edge part of the one-piece rubber plug 60 adjacent to the second seal hole 63. The grooves 65 arranged below the second seal hole 63 are arranged along the lateral direction in the back view and extend laterally outward of both left and right ends of the second seal hole 63. The grooves 65 arranged to the left of the second seal hole 63 are arranged along the vertical direction in the back view and extend vertically outward of both upper and lower ends of the second seal hole 63.

Inner peripheral lips 66 are formed in a central part in the front-rear direction on the inner peripheral surface of the second seal hole 63, and guiding surfaces 67 are formed on outer sides of the inner peripheral lips 66 in the front-rear direction. The inner peripheral lips 66 are arranged at an upper position in the entire guiding surface 67 in the back view. A lateral cross-sectional shape of the guiding surface 67 is rectangular on an entrance side and circular on a back side. The guiding surface 67 is formed to become gradually circular from the entrance side toward the back side. Note that the rectangular shape means not only a rectangular shape with right-angled corner parts, but also a rectangular shape with rounded corner parts.

Next, functions and effects of the connector 10 are described.

The retainer 14 is partially locked in the housing 11 and the one-piece rubber plug 60 is fit into the housing 11 from behind. The terminal module 13 is inserted through the one-piece rubber plug 60 before the terminal fittings 12 are inserted. This is for the following reason. That is, since the terminal module 13 is configured to cover the outer peripheries of the inner conductor terminals 20 by the dielectric 21, the terminal module 13 is larger than the terminals constituted only by the inner conductor terminals 20 and a difference in radial dimension between the terminal module 13 and the second wire 82 is large. Thus, in inserting the terminal module 13 through the second seal hole 63, the front end of the terminal module 13 may be caught by the periphery of the second seal hole 63 to cut the one-piece rubber plug 60. Thus, it is preferred to reduce an insertion force when the terminal module 13 is inserted. In that respect, if the terminal module 13 is inserted first as described above, the one-piece rubber plug 60 is easily deflected as compared to the case where the terminal fittings 12 are inserted first. Thus, the insertion force of the terminal module 13 can be reduced. In this way, the front end of the terminal module 13 is less likely to be caught, with the result that the cutting of the one-piece rubber plug 60 can be suppressed.

Further, the dielectric 21 of the terminal module 13 is formed with the front slopes 46 inclined in directions to reduce the external dimensions toward the front end. Thus, when the terminal module 13 is inserted into the second seal hole 63 from behind, the front slopes 46 of the dielectric 21 enter the second seal hole 63 to gradually widen the second seal hole 63. Thus, the front end of the terminal module 13 is less likely to be caught, with the result that the cutting of the one-piece rubber plug 60 can be suppressed.

Furthermore, the front slopes 46 are provided on the projecting pieces 45 projecting forward from the front wall 44. That is, the front slopes 46 are arranged forward of the front wall 44. Thus, the external dimensions of the front end of the terminal module 13 can be further reduced. As a result, the front end of the terminal module 13 is even less likely to be caught by the one-piece rubber plug 60.

Further, the second seal hole 63 is arranged on the side of the left-lower corner part 61A in the one-piece rubber plug 60 in the back view. Thus, a part of the one-piece rubber plug 60 on the side of the corner part 61A is thinned by the second seal hole 63 and easily deflected. As a result, the cutting of the one-piece rubber plug 60 can be suppressed. Moreover, since the second wire 82 can be arranged away from the first wires 81, the second wire 82 is less affected by noise from the first wires 81.

Further, the grooves 65 are formed between the second seal hole 63 and the outer peripheral edge part of the one-piece rubber plug 60 adjacent to the second seal hole 63. Thus, parts of the second seal hole 63 on the sides of the grooves 65 are more easily deflected.

Further, not a projection, but the recess 51 is formed as a part to be locked to the locking lance 95 of the housing 11 is formed in the lower surface of the dielectric 21 in the terminal module 13. Thus, also after a front end part of the terminal module 13 passes through the second seal hole 63, the terminal module 13 does not largely push and widen the second seal hole 63 and is less likely to be caught by the one-piece rubber plug 60. As a result, the cutting of the one-piece rubber plug 60 can be suppressed.

When the entire terminal module 13 passes through the second seal hole 63, the second wire 82 connected to the terminal module 13 is held in close contact with the inner peripheral lips 66 of the second seal hole 63 in a liquid-tight manner. The terminal module 13 in an inserted state may be pulled out for maintenance or other reason. Also in this case, a pressure applied between the terminal module 13 and the one-piece rubber plug 60 is preferably reduced. To that end, the dielectric 21 of the terminal module 13 is formed with the first rear slope 48A, the second rear slopes 48B and the third rear slope 58 inclined in directions to reduce the external dimensions toward the rear end. Thus, in pulling out the terminal module 13 from the second seal hole 63, the first, second and third rear slopes 48A, 48B and 58 of the terminal module 13 enter the second seal hole 63 to gradually widen the second seal hole 63. Thus, the rear end of the terminal module 13 is less likely to be caught, with the result that the cutting of the one-piece rubber plug 60 can be suppressed.

After the second wire 82 is passed through the second seal hole 63, each terminal fitting 12 is inserted through each first seal hole 62 and the first wire 81 connected to the terminal fitting 12 is passed through the first seal hole 62 in a liquid-tight manner. After the terminal module 13 and the plurality of terminal fittings 12 are accommodated into the housing 11, the retainer 14 is fully locked. Further, rearward escape of the one-piece rubber plug 60 is prevented by the rear member 15 mounted in the housing 11. A forward displacement of the terminal module 13 arranged in the housing 11 is restricted by the front member 16 mounted on the housing 11. However, the front end part of the terminal module 13 is arranged to project further forward than the front end of the front member 16. A mating housing 91 of the mating connector 90 is formed with a fitting groove 94 into which the front end part (including the projecting pieces 45) of the terminal module 13 is fit as shown in FIG. 1. When the connector 10 is connected to the mating connector 90, the front end part of the terminal module 13 is fit into the fitting groove 94 of the mating housing 91, whereby displacements in the vertical and lateral directions are restricted.

Other Embodiments of Present Disclosure

The embodiment disclosed this time should be considered illustrative in all aspects, rather than restrictive.

(1) Although the front slopes are provided on both the front wall and the projecting pieces in the above embodiment, the front slopes may be provided only on the projecting pieces. Further, the front slopes may be provided on the front wall without providing the projecting pieces.

(2) Although both the front slopes and the rear slopes are provided in the above embodiment, only the front slopes may be provided or only the rear slopes may be provided.

(3) Although the recess is provided in the above embodiment, the recess may not be provided.

(4) Although the terminal module is proved on the corner part side of the one-piece rubber plug in the above embodiment, the terminal module may be provided on a central side of the one-piece rubber plug.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A connector, comprising:

a terminal fitting;

a terminal module including an inner conductor terminal and a dielectric for covering an outer periphery of the inner conductor terminal, the terminal module having larger external dimensions than the terminal fitting;

a housing for accommodating the terminal fitting and the terminal module;

a first wire to be connected to a rear part of the terminal fitting;

a second wire to be connected to a rear part of the inner conductor terminal; and a one-piece rubber plug formed with a first seal hole and a second seal hole, the first wire being passed through the first seal hole in a liquid-tight manner, the second wire being passed through the second seal hole in a liquid-tight manner.

2. The connector of claim 1, wherein the dielectric is formed with a front slope inclined in a direction to reduce the external dimensions toward a front end.

3. The connector of claim 2, wherein:

the dielectric includes:

a front wall formed with a tab insertion opening, a tab of a mating terminal fitting being inserted through the tab insertion opening, and a guiding surface for guiding the tab into the tab insertion opening, and a projecting piece projecting forward from the front wall, and the front slope is provided on the projecting piece.

4. The connector of claim 1, wherein the dielectric is formed with a rear slope inclined in a direction to reduce the external dimensions toward a rear end.

5. The connector of claim 1, wherein:

the housing includes a locking lance, and a recess is formed in an outer peripheral surface of the terminal module, the locking lance being locked to the recess.

6. The connector of claim 1, wherein:

the one-piece rubber plug includes four corner parts, and the second seal hole is arranged on the side of any one of the four corner parts.

* * * * *